United States Patent [19]

D'Alessio

[11] Patent Number: 4,493,578

[45] Date of Patent: Jan. 15, 1985

[54] SCAFFOLDING CONNECTOR AND SYSTEM

[75] Inventor: Michael S. D'Alessio, Flushing, N.Y.

[73] Assignee: Harsco Corporation, Camp Hill, Pa.

[21] Appl. No.: 431,115

[22] Filed: Sep. 30, 1982

[51] Int. Cl.[3] ..... F16B 7/00

[52] U.S. Cl. ..... 403/49; 403/246; 403/190; 211/182; 182/178

[58] Field of Search ..... 182/179, 178; 403/49, 403/189, 190, 245, 246; 211/182

[56] References Cited

U.S. PATENT DOCUMENTS

| | | | |
|---|---|---|---|
| 3,420,557 | 1/1969 | Francis et al. | 182/179 |
| 3,817,641 | 6/1974 | Steele et al. | 182/179 X |
| 3,992,118 | 11/1976 | Slegers | 182/179 X |
| 4,044,523 | 8/1977 | Layher | 182/179 X |
| 4,273,463 | 6/1981 | Dobersch | 182/179 X |
| 4,394,095 | 7/1983 | Layher . | |

FOREIGN PATENT DOCUMENTS

| | | |
|---|---|---|
| 2822676 | 11/1979 | Fed. Rep. of Germany . |
| 1278243 | 6/1972 | United Kingdom . |
| 2066341 | 7/1981 | United Kingdom . |
| 2090640 | 7/1984 | United Kingdom . |

*Primary Examiner*—Cornelius J. Husar
*Assistant Examiner*—Joseph A. Fischetti
*Attorney, Agent, or Firm*—Curtis, Morris & Safford

[57] ABSTRACT

In post and runner type scaffolding, a uniquely formed integral connector is created from the end of the runner or other similar cross-member. The integral connector secures to a scaffolding post bracket (preferably in the form of a ring flange concentrically affixed to said post and having a circular array of identical cutouts) and abuts forcefully against the convex surface of said post by means of a wedge acting through one of said cutouts. The connector has a longitudinally extending cross-slot in its end of a width and depth to accommodate the bracket therein, dividing the connector end into upper and lower limbs. The free end of each limb terminates with the tubular walls thereof reformed from the tubular shape of said cross-member to a shape (preferably more flattened) effective to strengthen and stiffen said limbs for their intended use of supporting scaffolding loads and connection stresses. A hole is formed in each limb so as to be adapted to align generally with any one of the cutouts in said bracket to accommodate said wedge.

22 Claims, 12 Drawing Figures

FIG. 2
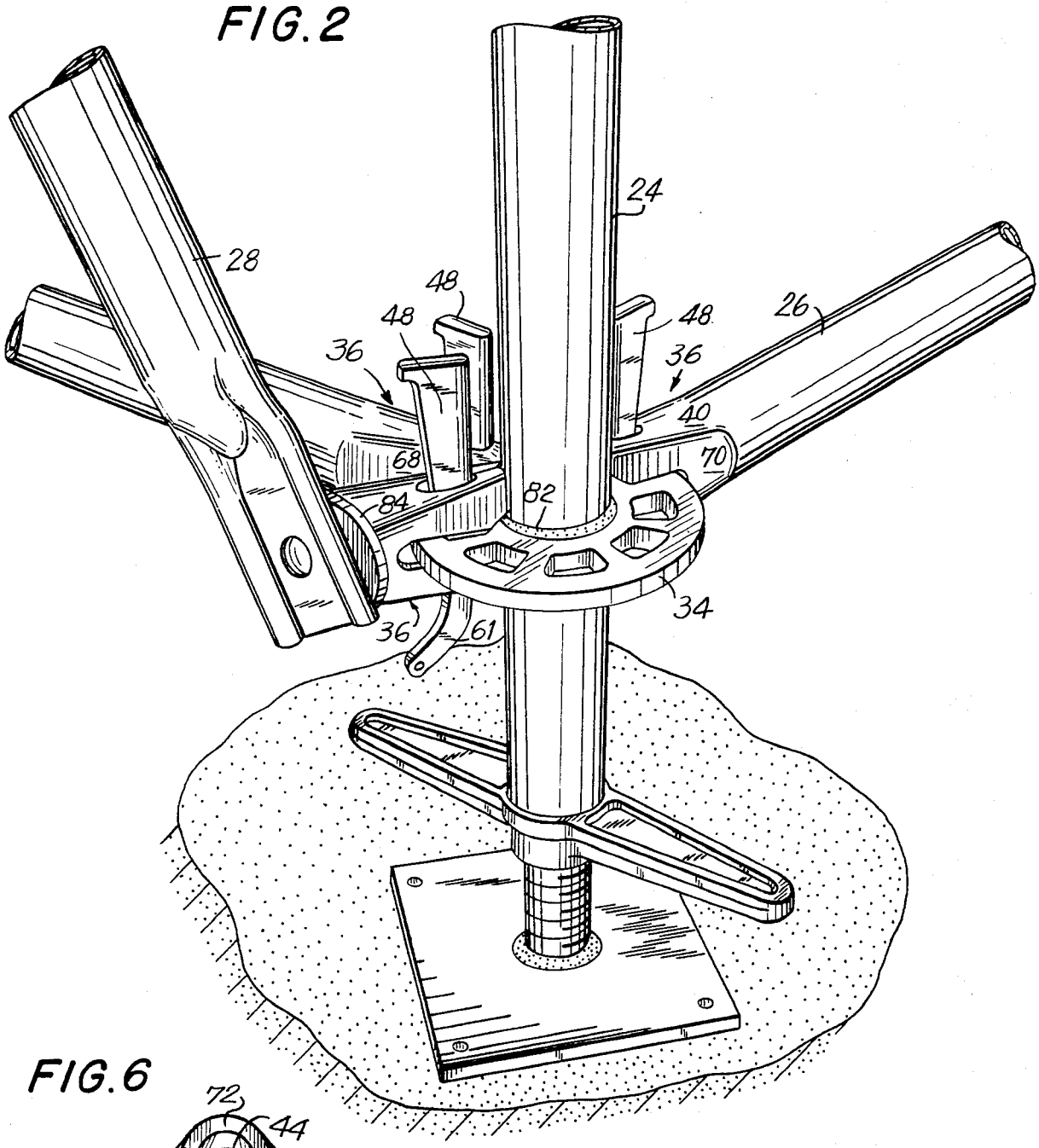
FIG. 6
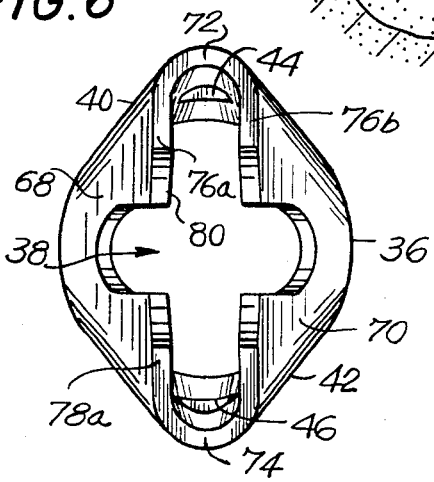
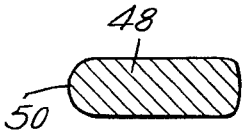
FIG. 7

26
48
68
40
36
42
70
44
52
56
7
57
50
24
38
46
61
62
54
80
82
34
60
58

SCAFFOLDING CONNECTOR AND SYSTEM

The present invention relates to scaffolding used in construction and other related industries, and particularly, to improvements in scaffolding systems and components of the post and runner type which has the versatile capacity of being assembled in irregular shapes (such as encountered in petrochemical construction and in shipbuilding), as well as in the more conventional rectangular grid pattern.

Most conventional scaffolding is made from welded end frames having two vertical legs with welded cross pieces, said frames being assembled as a basic unit in pairs with removable cross bracing. See for example, U.S. Pat. No. 3,190,405. This conventional scaffolding has the advantage of rigidity and quick assembly-disassembly (which derives from the use of the welded end frames. Conventional post and runner scaffolding are joined by the use of threaded clamps. These are labor intensive and time consuming to assemble and require more costly skilled labor to erect. There has been a continuing attempt over the years to improve the usefulness of the single post and runner type of scaffolding to increase the speed and ease of assembly, to improve rigidity, and at the same time to retain the versatility relative to irregular shapes.

Patents illustrating such earlier work include U.S. Pat. No. 3,179,212, issued Apr. 20, 1965, to P. E. Gostling; No. 3,420,557, issued Jan. 7, 1969, to L. W. Francis, et al.; No. 3,817,641, issued June 18, 1974, to R. E. Steele, et al.; No. 3,992,118, issued Nov. 16, 1976, to E. H. G. Slegers; No. 4,044,523, issued Aug. 30, 1977, to E. Layher; No. 4,273,463, issued June 16, 1981, to G. Dobersch and British Pat. No. 1,278,243, published June 21, 1972, to Elson.

These all commmonly teach the joinder of a runner (or other horizontal or diagonal cross-member) to a vertical upright circular post by means of a wedge fastening a connector at the end of the horizontal cross-member to the vertical post by interconnection with a bracket affixed thereto. The exception to this is the Slegers patent which uses the wedging action of a locking cup, rather than a separate wedge. The brackets used in the earlier patents were U-shaped loops or straps (called "sockets") whose ends were welded to the post. These loops are subject to being pulled off in daily use. This problem has been avoided in the ring or cup brackets utilized in the Elson, Layher or Dobersch type patents. However these latter brackets and their respective end connectors also have serious problems, particularly when made as castings, because of the difficulty of quality control due to slag inclusions, large grain areas, hairline fractures, and other imperfections having significant potential for failure. These imperfections are very difficult to detect and appear in a significant proportion of all castings. Also of concern is the difficulty in reliably heat treating castings to achieve effective welds for joining such brackets to the upright post and such end connections to the horizontal runners. Heat treating is required for strength, because of the type of cast metal needed to assure reasonable welds. This heat treatment is not always evenly done, and the resulting imperfections are also difficult to detect.

A universal feature for all known commercial scaffolding of this type (and also of the preferred embodiments taught by the aforementioned patents) includes the separate fabrication of the connector and the subsequent joinder thereof by welding, swaging, or the like, to the end of the horizontal cross-member. In a very brief description of FIGS. 8 and 9 in U.S. Pat. No. 3,420,557 (column 4, lines 51–56 and column 7, lines 12–21), there is a "paper" disclosure of a rudimentary connector formed from the end of a cross-member. This incidental description would be recognized by those skilled in the art not to involve a practical disclosure. The disclosed device, if integrally made from reasonably light tubing (so as to be commercially acceptable), could not be safety certified. For example, it is understood that the connector would not give a rigid connection and would be too fragile for normal loading and even incidental handling at a construction site. The disclosure has been presented as an incomplete afterthought which, if practical, would have warranted a more prominent discussion. There is no teaching of how to modify this embryonic concept to a practical design. Also, the disclosure has been in the context of contrary teachings with respect to the preferred embodiments (which all require separate fabrication and attachment of the nonintegral connectors to the ends of horizontal cross-members).

It is thus an object of this invention to develop a scaffolding connector and system which is simple of construction, is easy and reliable to use, has significant safety advantages over all potential and commercially available prior art, and makes a rigid joint when assembled.

Applicant has developed and herein discloses a practical scaffolding connector integrally formed in one, or preferably both, ends of a scaffolding cross-member. Surprisingly, this was accomplished merely by cutting and shaping the end of said cross-member without any need for heat treating or the like.

In the preferred embodiment hereafter described, the vertical post is concentrically welded to a conventional locking ring of the type formed as an annular disc have a plurality of cutouts (typically four or eight in number) equispaced about the ring and advantageously with substantially identical maximum and minimum radii. The term "cutout" applies generally to holes in the brackets or locking rings of scaffolding posts which pass axially therethrough and typically are formed by casting, by punching from flat plate, or (as preferred and taught by applicant) by forging.

The unique connector according to this preferred embodiment of the present invention is integrally formed in the end of a tubular horizontal cross-member. A horizontal cross-slot is centrally formed in the end face of the connector, thus forming two opposing notches in the latter thus permitting it to be closely fitted over the locking ring with the end face abutting the side of the post. In order to give strength to the upper and lower limbs of the connector created by the cross-slot and also to give a rigid joint between the end face of the connector and the post, the ends of each limb are formed in a U-shape, with the open end of each facing the other. The resulting essentially parallel legs of the U-shaped limbs insure at least four widely spaced points of contact with the post and also stiffen said limbs. This gives a solid base of contact between the end of the cross-member and the post. In fact, because the legs can have a slight lateral flex when the end of the cross-member is wedged against the post (as described below), the generally parallel legs can thus be constructed to flex into alignment with the post to give four widely spaced lines of contact, rather than mere points of contact.

In order for the end face of the connector to make the aforementioned preferred four points of contact (or in this preferred embodiment, four lines of contact) it is necessary that the web joining said legs be notched or otherwise recessed. This advantageous recessing should be at least sufficient to conform the web to the cylindrical shape of the circular post. However, since it would be costly to maintain exact tolerances for close interfitting, it is preferred that the recessing of the web be enough to insure the desired widely spaced contact between the legs and the post (without any contact of the webbing with the post).

A hole through each of the limbs of the connector is respectively shaped and positioned so that a wedge passed through this pair of holes and through one of the aligned cutouts in the locking ring, when the latter is positioned in the cross-slot of the connector, will rigidly fasten the cross-member to the vertical post. This pair of holes is perpendicular to the plane of the cross-slot and when in position on the locking ring is aligned parallel to the axis of the post.

When engaged, the outside edge of the wedge bears on the surface of each of the pair of holes which faces away from the post. The inside edge of the wedge (which is preferably inclined at approximately 7°) engages the inner surface of the cutout which faces said post. Thus, as the wedge is driven into place, the wedge forcefully presses the end face of the connector against the post to form a rigid connection.

Although in its broadest aspects, the bracket may have only a single cutout, it is preferred that there be at least four such cutouts spaced at 90° so that a conventional rectangular scaffolding can be erected. However, the full versatility of this equipment is not realized unless there are at least eight cutouts at 45° angles. These can be conveniently of identical configuration, or otherwise. Although the number of cutouts can be increased even further, it has been found that sufficient versatility in varying the angle of placement can be achieved with just eight cutouts, where the cutouts themselves are in the form of truncated sectors which subtend a sufficient angle (e.g. 32°) to permit the horizontal cross-members to be fixed at differing angles within a given cutout (for example, an approximate 16° variation is possible with a 32° cutout given the dimensions of the preferred embodiment shown in the drawings).

In this specification and in the accompanying drawings, I have shown and described preferred embodiments of my invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

FIG. 2 is a closeup perspective view showing the details of a preferred embodiment of the scaffolding system according to the present invention, including a conventional post and locking ring with a conventional jack screw, with the unique horizontal cross-members having connectors integrally formed in their ends, with each connector carrying its respective locking wedge;

FIG. 6 is an end view of the connector shown in FIGS. 4 and 5;

FIG. 7 is a horizontal cross section taken along lines 7—7 in FIG. 3 of the locking wedge;

Figure 1:
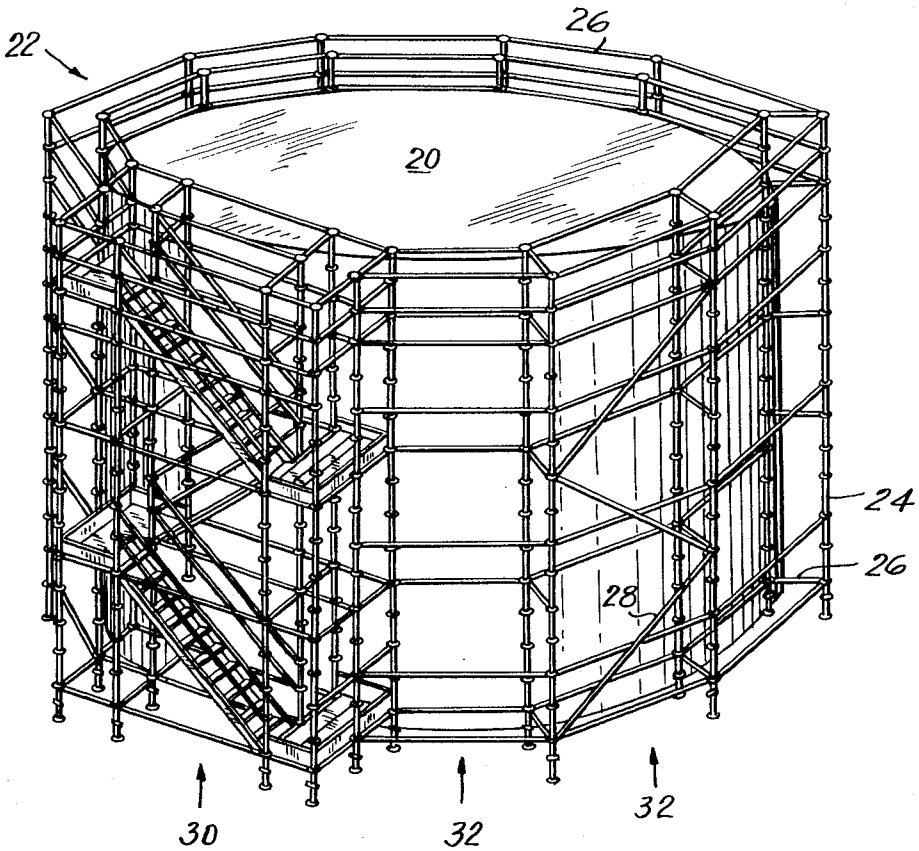
FIG. 1 is a perspective view showing the scaffolding system according to the present invention as employed with respect to an irregular shape such as a storage tank.

FIG. 1 shows the type of versatility that post and runner scaffolding systems have with regard to irregular shapes such as the illustrated storage tank 20. The scaffolding assembly 22 is made up of vertical support posts 24 joined to cross-members which can be either runners 26 or diagonals 28.

As illustrated in FIG. 1, this scaffolding assembly 22 has been formed into a free-standing stair tower 30 with support units 32 having pairs of longitudinal horizontals 26 of different lengths, thus enabling the scaffolding to form a polygonal support structure around the circular tank 20.

Figure 9:
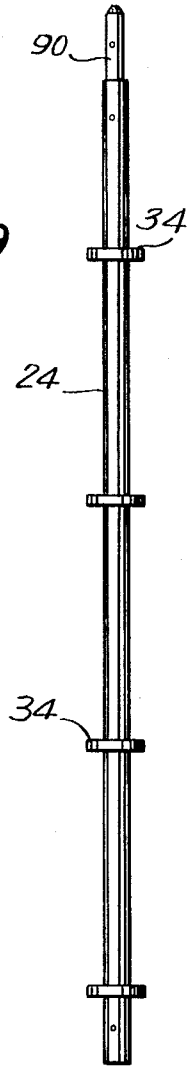
FIG. 9 is a side elevation of a vertical scaffolding post showing the positioning of the locking rings welded thereon.

As shown in FIGS. 2 and 9, the post 24 has a plurality of brackets 34 (illustrated in the form of locking rings) advantageously equispaced therealong.

Integrally formed in the end of the horizontal 26 is a connector 36 (see FIGS. 3 to 6 in particular). A horizontal cross-slot 38 is cut longitudinally into the free end of the integral connector 36, thus forming an upper limb 40 and a lower limb 42, preferably of equal size. Holes 44 and 46 are formed in the respective upper and lower limbs 40 and 42 to accommodate a locking wedge 48. The straight outer edge 50 of the wedge 48 is advantageously of a cylindrical shape. The holes 44 and 46 define corresponding circular surfaces 52 and 54 against which the wedge 48 bears when forcing the free end 56 of the connector 36 against the post 24 (see FIG. 3). Because there are no sharp angles in the preferred circular surfaces 52 and 54, the wedging forces from the correspondingly-shaped cylindrical wedge face 50 are more evenly spread and do not have an angled weak point to act on (as would be the case if the holes 44 and 46 were rectangular). This feature of applicant's invention further aids in the feasibility and reliability of his integral structure.

The inner edge 57 of the locking wedge functions as the opposing wedge surface which bears on the inner bearing surface 58 of one of the cutouts 60 in the locking ring 34.

In the preferred embodiment, the bearing surfaces 52 and 54 are equidistant from the free end 56 of the connector. The hole 44 is small enough to prevent the head of the wedge 48 from passing through, but is longitudinally large enough not to engage the wedge surface 57 when in the locked position. The sides of the hole 44 are sufficiently close together to engage the rivet 62 and thus prevent the complete disengagement of the wedge 48 from the connector 36. In contrast, the hole 46 in the bottom limb 42 is sufficiently wide to permit the wedge tip 61 with the retaining rivet 62 to pass through the hole 46, thus enabling the wedge 48 to be retracted away from the lower limb and to lie wholely within or along the length of the upper limb (see the dash-dot outline of the wedge 48 in FIG. 3). The particular J-shape of the wedge 48 ensures that the slot 38 is clear of obstruction by the wedge 48 during assembly of the connector onto the locking ring 34. It also permits the length of the wedge 48 to lie along the length of the horizontal 26 and be substantially out of harm's way during storage and assembly operations.

Figure 11:
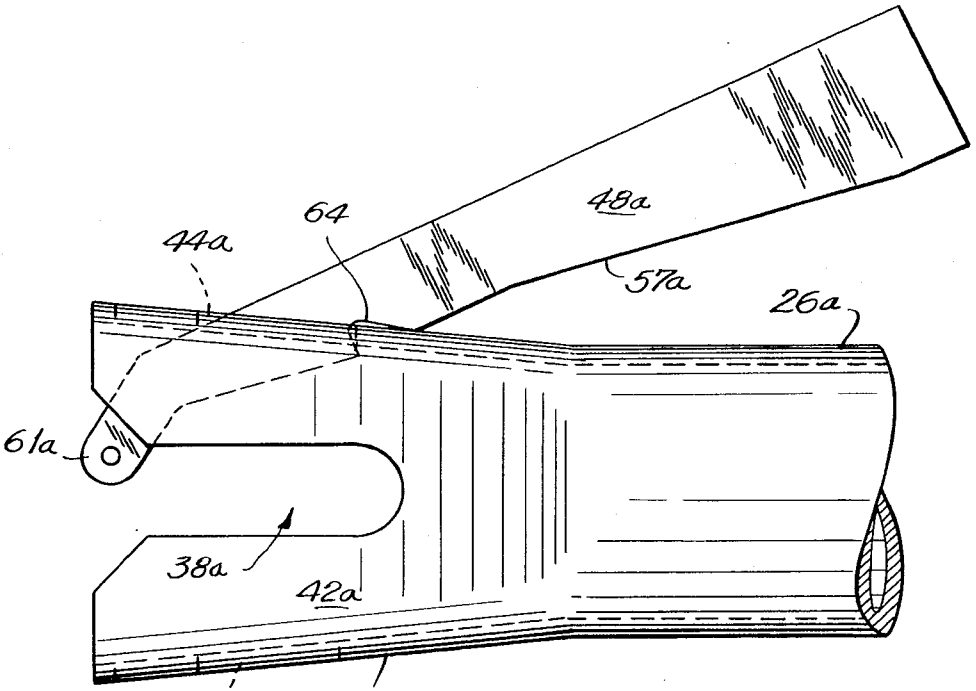
FIG. 11 is a side elevation showing a second embodiment of the present invention involving a modified wedge and connector assembly which is semiautomatic in operation.

Illustrated in FIG. 11 are a modified wedge **48*a* and connector 36*a* which are designed to enable the horizontal 26*a* to be placed on the locking ring 34 and cause the locking wedge 48*a* to drop into place through a cutout 60, usually without the necessity for actually handling the wedge 48*a***. In normal use this has been found to operate automatically at least 70% of the time. By careful proper handling this percentage can be significantly increased.

This modified locking wedge **48*a* has a notch 64 in the lower end of the inner edge 57*a*. This is positioned so that the greater portion of the wedge 48*a* protrudes from the upper hole 44*a* and lies back towards the length of the connector 26*a*. In this weighted position, the lower tip 61*a* of the wedge 48*a* (bearing the rivet 62) protrudes slightly into the cross-slot 38*a*. There is sufficient clearance between the chamfered lead-in to the slots 38*a* and the tip 61*a* of the wedge to permit the outer portion of the locking ring 34 and a cutout 60 to pass beneath the tip 61*a*. The length of the horizontal 26*a* is then aligned with the plane of the locking ring 34 whereby the tip 61*a* protrudes slightly into the cutout 60. Thus on further insertion of the locking ring 34 into the slot 38*a*, the wedge 48*a* is caused to tip up the wedge 48*a* and upon full insertion to drop down through the cutout 60 and through the hole 46*a* in the lower limb 42*a***.

The wedging surfaces 50 and 57 are preferably angled to each other at about 7°. The upper portion of the bearing surface 58 of the locking ring 34 is preferably inclined at about 5° to the vertical, thus giving both a good bearing surface and also enabling the locking ring to be forged rather than cast, resulting in a greatly superior structure. By forging the ring 34, the problems of casting fractures are avoided.

Figure 8:
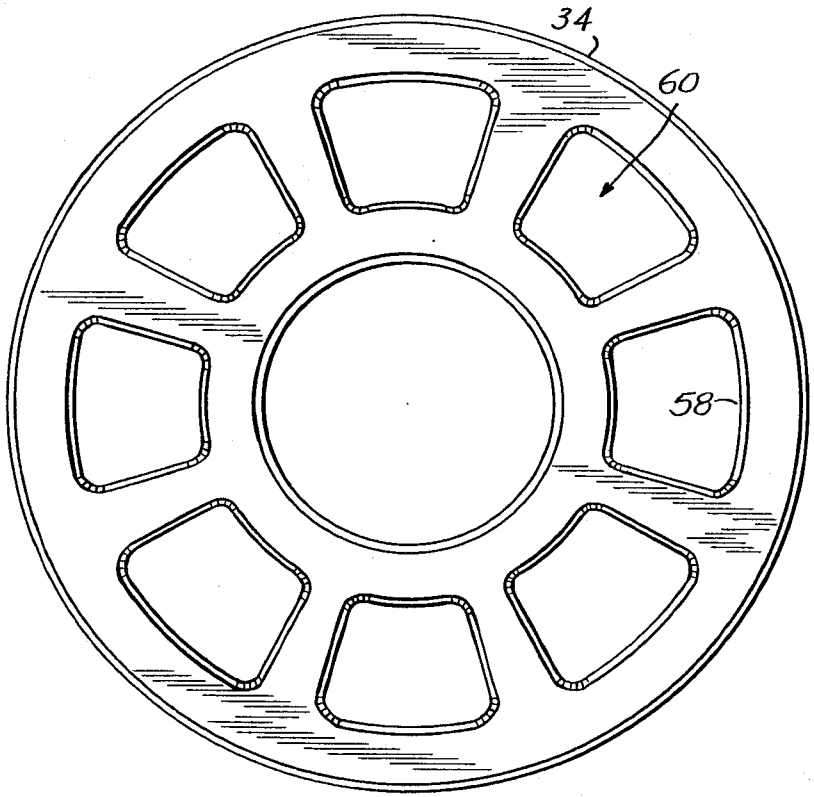
FIG. 8 is a plan view of preferred embodiment of the locking ring shown in FIGS. 2 and 3.

Referring to FIG. 8, it will be appreciated that each of the cutouts 60 should have the bearing surface 58 at a common maximum radius, so that the connector 36 can be effectively mounted in any one of the cutouts and be functional with respect thereto. The inner circular arc defining the opposite face of each of the cutouts 60 is preferably at the same minimum radius, or at least of a sufficiently small radius to prevent the bearing surface 50 of the wedge 48 from engaging that surface when in the operative position.

Figures 3, 4, 5:
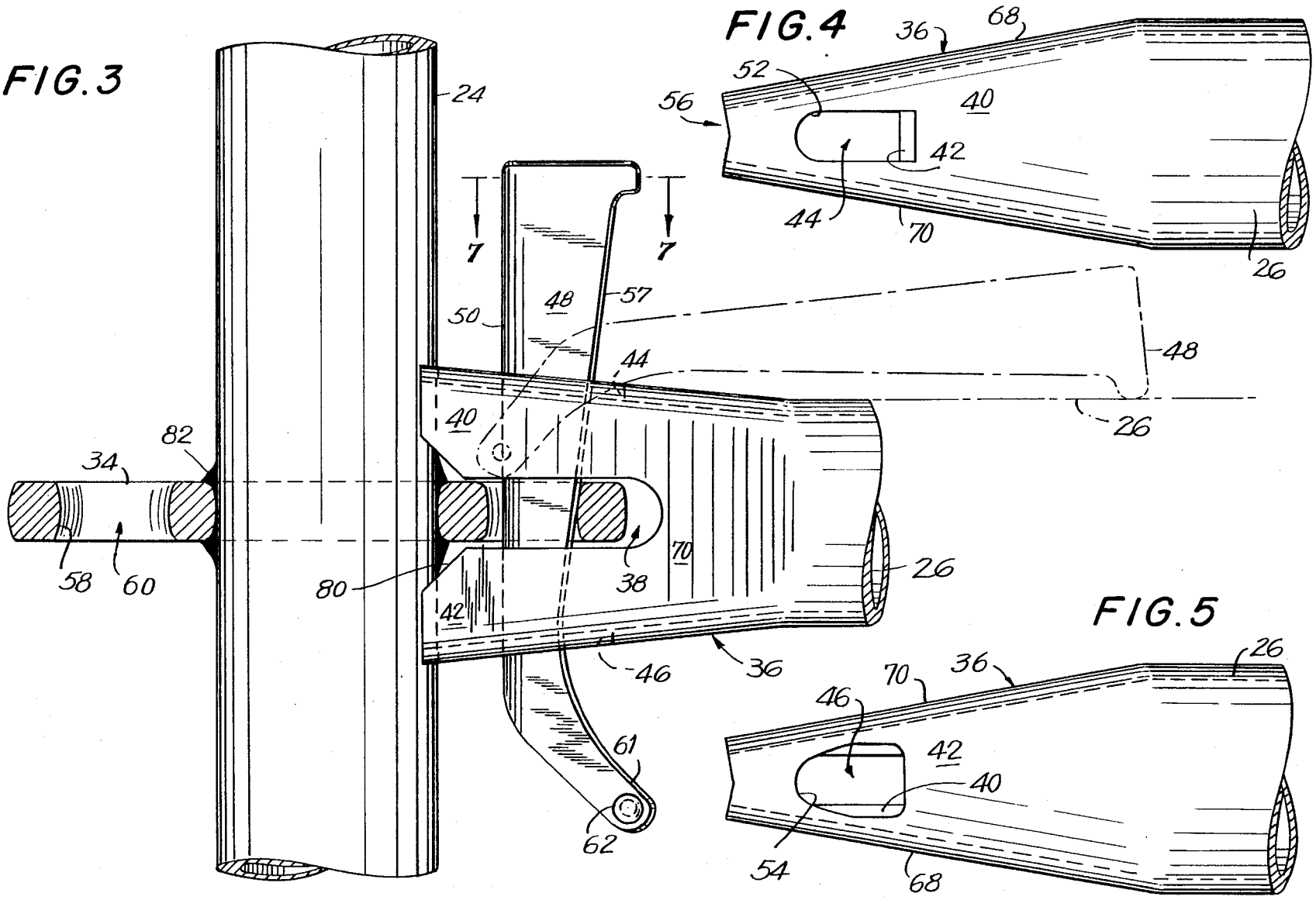
FIG. 3 is a side elevation, including a vertical cross section through the locking ring of the structure shown in FIG. 2.
FIGS. 4 and 5 are respectively top and bottom views of the connector shown in FIGS. 2 and 3.

Referring to FIG. 6, a particularly advantageous feature of applicant's unique invention is in forming an end of a tubular horizontal 26 into a connector 36 whose end face 56, being divided by the slot 38, results in two facing U-shapes. These can result from the connector being initially in the shape of a box channel. More typically, the horizontal 26 is made from circular tubing of essentially the same size as the vertical post 24. Applicant thus derives these U-shaped end faces from the circular tubing by flattening the sides of the tubular circular horizontal 26, preferably into straight sided cheeks 68 and 70. This has the advantage of stiffening the limbs and also of permitting eight or more connectors to be simultaneously mounted on the locking ring 34 and to abut their free ends against the post 24. By narrowing the tubing transversely, it is also simultaneously lengthened vertically. This has the advantage of more widely separating the web portion 72 and 74 of these two respective U-shaped end faces. The respective legs **76*a* & *b* and 78*a* & *b* are thus adequately widely spaced trasversely and advantageously more widely spaced vertically so as to give an unusually solid base of contact by the end face 56 against the side of the post 24. These parallel legs 76*a*&*b* and 78*a*&*b* are of a length sufficient effectively to stiffen the relatively thin-walled limbs 40 and 42 for their intended use. The preferred spacing between the legs ranges from $\frac{1}{4}$ to $\frac{2}{3}$ the diameter of said cross-member. As viewed in FIGS. 4 and 5, the webs 72 and 74 are preferably formed in a V-shape with the legs of the V perpendicular to the adjacent cheek 68 or 70 of the connector 36. With the cheeks 68 and 70 substantially radially aligned relative to the central axis of the post when engaged as shown in FIG. 3, the faces of the legs 76*a* & *b* and 78*a* & *b* are seated flat against the surface of the post 24**.

The connector 36 at the open end of the cross-slot 38 has chamfered faces 80 to serve as a lead-in to the slot 38 for the locking ring 34 and also to provide clearance for the welding seam 82 joining the ring 34 to the post 24.

Figure 10A:
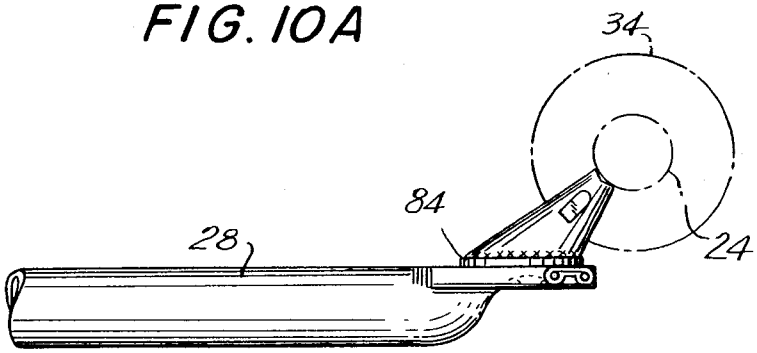
FIG. 10A is a plan view of a diagonal cross-member having the unique connector according to the present invention, pivotally connected at a 45° angle to the flattened end of the diagonal cross-member.
Figure 10B:
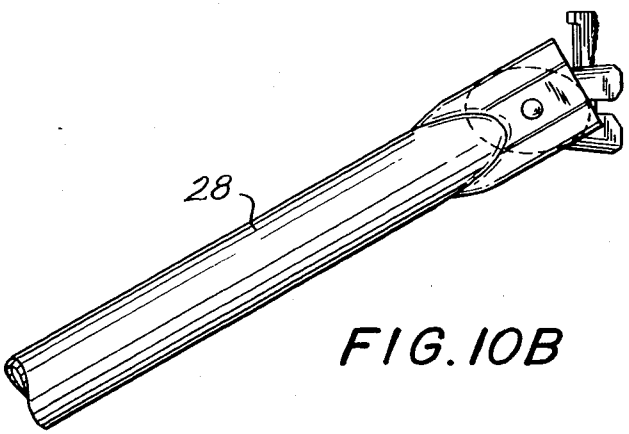
FIG. 10B is a side elevation of the structure shown in FIG. 10A.

FIGS. 2 and 10A & B illustrate how the connector 36, integrally formed from circular tubing, can be employed in making diagonal bracing 28. As illustrated, the connector 36 is cut at a 45° angle to its length and welded to an elliptical plate 84. The end of the diagonal tubing 28 is flattened and riveted to the plate 84. By riveting, the plate 84 is enabled to rotate relative to the diagonal 28 and thus permit the diagonal to serve as either a right or left-hand diagonal.

Figure 12:
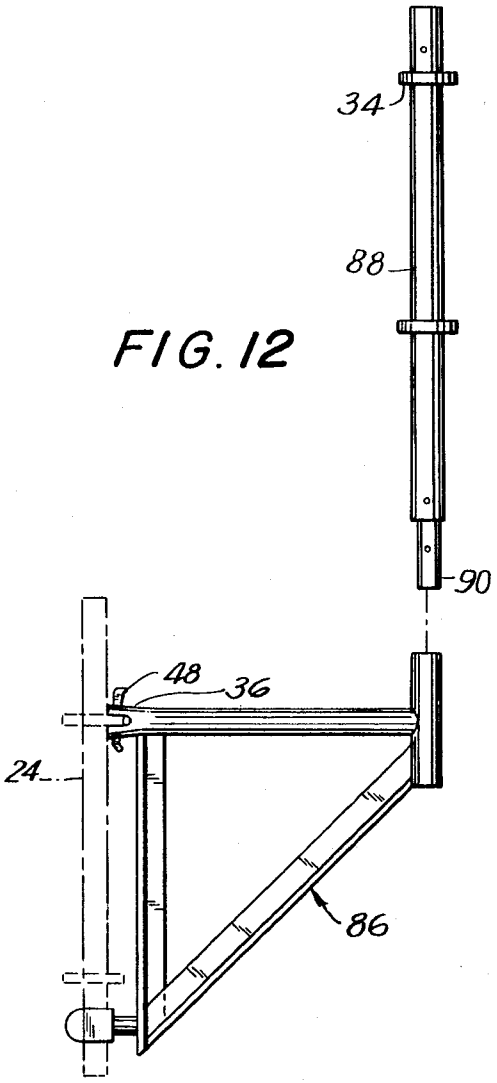
FIG. 12 is a side elevation of a sidewall bracket assembly (and of an interconnectable guard rail post) incorporating the unique connector of the present invention.

FIG. 12 illustrated how the present invention can be adapted for use with a sidewall bracket 86, optionally joined to a guard rail post by a riveted coupling pin 90.

I claim:

1. A scaffolding connector positioned at one end of a scaffolding cross-member and adapted to engage a bracket affixed to a scaffolding post and to be fastened to said bracket and against the convex surface of said post by a wedge inserted through a cutout in said bracket, said connector comprising being integrally formed from one end of a tubular member with a longitudinally extending cross-slot in said end of a width and depth to accommodate said bracket therein, said slot dividing said end into an upper limb and a lower limb, the free end of the connector being deformed from the tubular shape of the tubular member such that the two opposing sides of said connector which contain said cross-slot are gradually narrowed to the free terminal end of the connector while remaining spaced one side from the other to give a shape which is effective to strengthen and stiffen said limbs for supporting scaffolding loads and connection stresses, a pair of wedge holes with one hole formed in one limb and the other hole formed in the other limb so that said pair of holes aligns substantially perpendicularly to said slot, said pair of holes further being positioned and shaped so as to align with said bracket's cutout is potentially wedging relationship relative to said wedge when the bracket is positioned in the cross-slot of said connector with the free ends of said limbs abutting said post.

2. A connector according to claim 1, wherein the end of said connector incorporates a lateral stabilizing means which is adapted to engage the convex surface of said post at at least two widely spaced lateral points when said connector is fastened to said post aligned along a radius of said post thereby giving lateral stability to such connection and also to aid in such radial alignment.

3. A connector according to claim 2, wherein said tubular member is said cross-member.

4. A connector according to claim 3, further comprising a chamfered lead-in to said cross-slot, wherein said wedge further comprises a notch in the inner edge of said wedge positioned closer to the tip than to the head of said wedge with a steeper wall towards the tip and a more gradually sloping wall towards said head, said wedge being further shaped such that with the notch engaging the rearward surface of the hole in the upper limb and with the outer edge of the wedge engaging the forward surface of said hole the wedge rests relatively close to the upper surface of the cross-member while the tip of the wedge protrudes sufficiently into the chamfered cross-slot to permit the outer portion of said bracket and its cutout to pass into said slot and yet to engage the trailing surface of said cutout with said bracket longitudinally aligned with said cross-member.

5. A connector according to claim 4, wherein the wedge is J-shaped.

6. A connector according to claim 3, wherein the cross-member and the post are formed from circular tubing of substantially the same diameter.

7. A connector according to claim 6, wherein the shape of the limbs of said connector comprises a substantial increase relative to said tubular shape in the outermost separation of the free ends of said limbs substantially at right angles to said cross-slot.

8. A connector according to claim 2, wherein the cross-member and the post are formed from circular tubing of substantially the same diameter; and the shape of the limbs of said connector comprises a substantial transverse narrowing of the free terminal end of said connector, at said cross-slot, from said tubular shape to one eighth or less of the circumference of said post, and a substantial increase in the outermost separation of the free ends of said limbs substantially at right angles to said cross-slot.

9. A scaffolding system comprising a vertical post with at least one bracket affixed thereto, a cross-member having an integral connector in accordance with claim 8, a wedge securely positioned in said pair of holes and through a cutout in said bracket thereby fastening said cross-member to said post through said connector and bracket.

10. A system according to claim 9, wherein said bracket comprises a flat annular locking ring concentric with said post and having a plurality of cutouts whose maximum effective wedging radii are all the same.

11. A system according to claim 9, wherein said tubular member in said cross-member, said cross-member and the post are formed from circular tubing of substantially the same diameter, said cross-slot has a chamfered lead-in, the free end of each of the limbs being U-shaped and having two legs which are substantially parallel and are spaced apart by a distance which ranges from $\frac{1}{4}$ to $\frac{2}{3}$ the diameter of said cross-member, such spacing between the upper pair of said legs is substantially equal to the spacing between the lower pair of said legs, and all four legs are each adapted to engage said post in at least one respective point with each such point in the upper limb being separated from each such point in the lower limb by a distance substantially greater than the diameter of said cross-member.

12. A system according to claim 11, wherein said bracket comprises a flat annular locking ring concentric with said post and having eight identical cutouts therein each spaced at 45° relative to the other about said post and said wedge having a generally 7° tapered conformation.

13. A connector according to claim 2, wherein the lateral stabilizing means is formed by a recess in the free end of each limb of said connector.

14. A connector according to claim 1, wherein said tubular member with its integral connector has a base plate fixed thereto at 45° to the symmetrical plane through said wedge holes in said limbs and an end of said separate cross-member is longitudinally flattened with said flattened end and said base plate being pivotally pinned together.

15. A scaffolding connector positioned at one end of a scaffolding cross-member which latter is made from circular tubing of essentially uniform diameter and which connector is adapted to engage a bracket affixed to a scaffolding post and to be fastened to said bracket and against the convex surface of said post by a wedge inserted through a cutout in said bracket, said connector comprising being integrally formed from one end of a tubular member with a longitudinally extending cross-slot in said end of a width and depth to accommodate said bracket therein, said slot dividing said end into an upper limb and a lower limb, the free end of each limb terminating with the walls thereof being reformed in shape from the tubular shape of said cross-member to a shape having a substantial transverse narrowing of the free end of said connector, at said cross-slot, and a substantial increase in the outermost separation of the free ends of said limbs substantially at right angles to said cross-slot such that two opposing sides of the connector containing said cross-slot are partially flattened to form an inwardly angled end face which is narrowed in width and elongated in height relative to said diameter which shape is effective to strengthen and stiffen said limbs for supporting scaffolding loads and connection stresses, a pair of holes with one hole formed in one limb and the other hole formed in the other limb so that said pair of holes aligns substantially perpendicularly to said slot, said pair of holes further being positioned and shaped to align with the cutout in said bracket when the latter is positioned in the slot of said connector with the free ends of said limbs abutting said post, those of the respective surfaces defining said holes which face away from said post are adapted to bear on said wedge when positioned therein, and said holes are adapted to accommodate said wedge so that the latter is free to bear opposingly against the bracket cutout surface which faces said post.

16. A connector according to claim 15, wherein said bearing surfaces of the wedge holes in said limbs have a generally circular configuration adapted to match a correspondingly-shaped cylindrical surface of a wedge operative therein.

17. A connector according to claim 15, further comprising a wedge mounted in said hole in said upper limb and said wedge and said hole being shaped so that neither the head nor the tip of the wedge can pass through said hole and further shaped so that with the main body of the wedge outside of said connector and substantially parallel to the longitudinal axis of the cross-member the tip of the wedge remains within the connector but is removed from encroaching on the cross-slot.

18. A connector according to claim 17, wherein the wedge is J-shaped.

19. A connector according to claim 15, wherein the end of said connector is recessed sufficiently such that each limb is adapted to engage the convex surface of said post at at least two widely spaced lateral points when said connector is fastened to said post aligned along a radius of said post thereby giving lateral stability to such connection and also to aid in such radial alignment.

20. A connector according to claim 15, wherein the free end of each limb terminates with the tubular walls thereof forming a generally U-shape, the four legs from the two U-shaped limbs being of a length sufficient effectively to stiffen said respective limbs for their intended use, the portion of the ends of said limbs apart from the four legs being recessed enough to ensure at least four widely spaced points of contact respectively between each of the four legs and the convexly curved post when said connector is fastened to said post.

21. A connector according to claim 20, wherein the two legs comprising part of the free end of each of the U-shaped limbs are substantially parallel and are spaced apart by a distance which ranges from $\frac{1}{4}$ to $\frac{2}{3}$ the diameter of said cross-member, and such spacing between the upper pair of said legs is substantially equal to the spacing between the lower pair of said legs, and all four legs are each adapted to engage said post in at least one respective point with each such point in the upper limb being separated from each such point in the lower limb by a distance substantially greater than the diameter of said cross-member.

22. A connector according to claim 21, further comprising a chamfered lead-in to said cross-slot, wherein said wedge further comprises a notch in the inner edge of said wedge positioned closer to the tip than to the head of said wedge with a steeper wall towards the tip and a more gradually sloping wall towards said head, said wedge being further shaped such that with the notch engaging the rearward surface of the hole in the upper limb and with the outer edge of the wedge engaging the forward surface of said hole the wedge rests relatively close to the upper surface of the cross-member while the tip of the wedge protrudes sufficiently into the chamfered cross-slot to permit the outer portion of said bracket and its cutout to pass into said slot and yet to engage the trailing surface of said cutout with said bracket longitudinally aligned with said cross-member.

* * * * *

UNITED STATES PATENT AND TRADEMARK OFFICE

CERTIFICATE OF CORRECTION

PATENT NO. : 4,493,578

DATED : January 15, 1985

INVENTOR(S) : Michael S. D'Alessio

It is certified that error appears in the above-identified patent and that said Letters Patent is hereby corrected as shown below:

Column 7, line 7, after "cutout" delete "is" and insert --in--.

Signed and Sealed this

*Seventh* Day of *May 1985*

[SEAL]

*Attest:*

DONALD J. QUIGG

*Attesting Officer* *Acting Commissioner of Patents and Trademarks*